United States Patent [19]

Koransky

[11] 4,167,071

[45] Sep. 11, 1979

[54] GOLF SHOE

[76] Inventor: Herbert Koransky, 39 Mechanic St., Somerville, N.J. 08876

[21] Appl. No.: 832,348

[22] Filed: Sep. 12, 1977

[51] Int. Cl.[2] ..... A43B 5/00; A43C 15/00; A63B 69/36

[52] U.S. Cl. ..... 36/127; 36/67 B; 36/134; 273/32 C; 273/187 B

[58] Field of Search ..... 36/127, 134, 135, 67 B, 36/67 D; 273/187 B, 32 C

[56] References Cited

U.S. PATENT DOCUMENTS

| | | | |
|---|---|---|---|
| Re. 21,173 | 8/1939 | Fuller | 36/67 B |
| 2,095,095 | 10/1937 | Howard | 36/127 X |
| 3,218,734 | 11/1965 | O'Brien | 36/134 X |
| 3,311,999 | 4/1967 | MacNeill | 36/127 |
| 3,964,180 | 6/1976 | Cortese | 36/135 |

*Primary Examiner*—James Kee Chi

*Attorney, Agent, or Firm*—Posnack, Roberts, Cohen & Spiecens

[57] ABSTRACT

One golf shoe of a pair of golf shoes worn by a golfer is designed to aid the golfer to take a strong, braced stance with his right foot if he is a right-handed golfer or with his left foot if he is a left-handed golfer. This is accomplished by making the spikes on the outer edge or periphery of the shoe longer than the other spikes on the same shoe and on the other shoe. The spikes may also or alternatively be thicker for resistance to penetration into the ground or for added strength. The spikes may also be broader on the bottom or elsewhere to prevent too much penetration into the grass or dirt.

11 Claims, 5 Drawing Figures

FIG.1
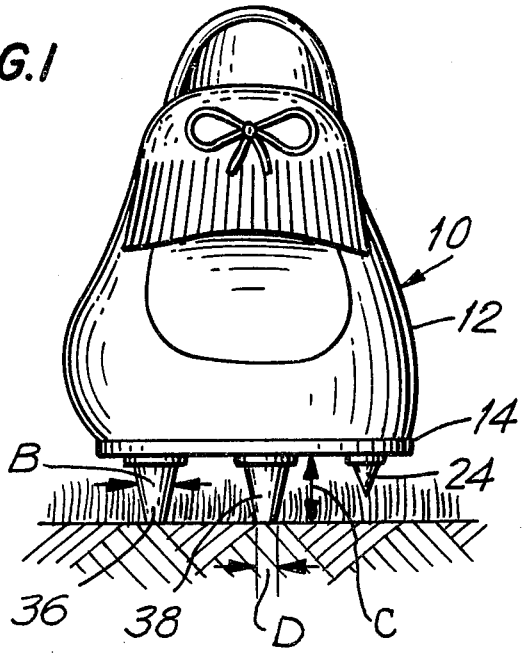
FIG.2
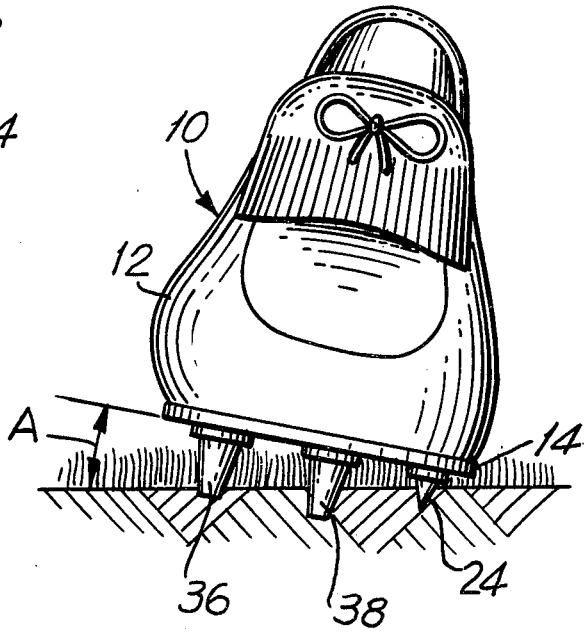
FIG.3
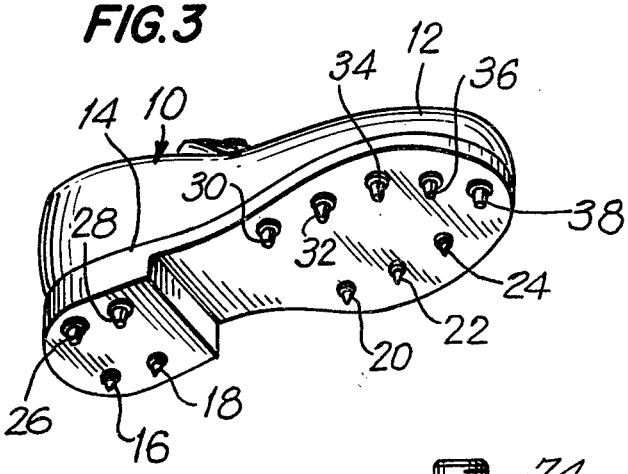
FIG.4
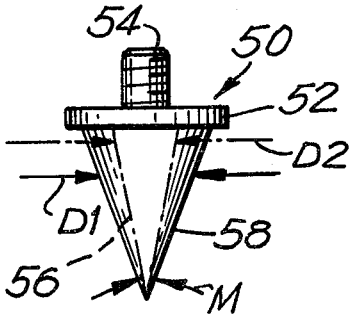
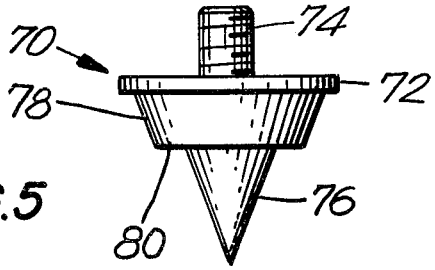
FIG.5

GOLF SHOE

FIELD OF INVENTION

This invention relates to golf shoes and to methods of improving the same.

BACKGROUND

A common fault in the golf swing is the tendency to shift the weight to the outside of the right foot by a right-handed golfer or to the outside of the left foot by a left-handed golfer. This causes pop-ups and other mis-hit balls.

U.S. Pat. No. 3,789,523 illustrates a shoe with a level ground plane and inner spikes longer than outer. It appears that both shoes are designed to be worn that way. The idea is to prevent sway by tilting the weight on both feet inwardly. I have determined that it is only the outside or strong-side foot that needs to be braced to prevent sway and it is not necessary to redesign both shoes. In addition, shoes in U.S. Pat. No. 3,789,523 are level to the ground whereas a tilted outside shoe would provide more leverage and brace to prevent sway than would a level shoe or shoes.

U.S. Pat. Nos. 3,951,407 and 3,195,891 illustrate attachable braces to be added to golf shoes to attempt to prevent sway. They need to be attached, adjusted and detached constantly, as the case may be, adding materially to the time and trouble involved in playing golf, and further involving constant bending and hand and foot manipulation. Also, the entire outside of the shoe is not grounded, but only a small portion in the area of the brace, the balance of the outside of the shoe being suspended in air.

U.S. Pat. No. 3,964,180 refers to detachable supports to be placed over the spikes of an existing golf shoe, and which must be placed on and taken off between golf shots. This requires constant hand and foot manipulation by the golfer, in addition to a place to keep them and possible loss between shots, as well as the possibility of dislodgement during the shot since they are magnetically attached. There is also a problem with worn spikes or mud and dirt which must be removed before use.

U.S. Pat. No. 2,847,769 describes a golf shoe with a tilted sole. This involves substantial extra expense in shoe manufacture.

SUMMARY OF THE INVENTION

An object of this invention is to improve the golf swing and to prevent sway to the outside of the right foot or left foot, whichever is the dominant side, as the case may be.

This is accomplished by means of redesigning the spikes on the outside periphery of the right shoe or left shoe corresponding to the dominant side, which spikes are, for example, larger, longer, wider at base and/or wider at the distal end touching the ground. The result is a tilted brace or platform type effect making it difficult and almost impossible for the golfer to shift his weight to the outside of the rearmost foot during the backswing.

The design of the shoe may even be such that it cannot be used for extended walking, other than in areas around the ball, since it tilts the foot inward at a noticeable angle. It may be designed chiefly for those golfers who ride carts. However, designs are possible within the scope of the invention which do permit comfortable walking.

The golf shoe in this invention, as noted above, may include extra length and/or width spikes on the outside edge (right edge of the right shoe for right-handed golfers, contra for left handers). This is intended to provide a tilted brace on that foot against which the golfer can swing without transferring his weight to the outside of this foot, thus, preventing sway, which is a fatal flaw in golf and causes pop-ups and mis-hit balls.

To achieve the above and other objects of the invention there is provided footwear for a golfer comprising a pair of shoes for the left and right feet of the golfer, each of said shoes including a sole and spikes depending from said sole. Said sole has inner and outer peripheries adjacent which the spikes are located. The spikes have diametral and axial dimensions. All of the spikes on one of said shoes and the spikes adjacent the inner periphery of the other of said shoes have substantially the same diametral and axial dimensions. At least some of the spikes adjacent the outer periphery of said other shoe have at least one of said dimensions enlarged so as to exceed substantially the corresponding dimension of the spikes on said one shoe and on the inner periphery of said other shoe.

According to one embodiment of the invention, the spikes adjacent the outer periphery of said other shoe have an enlarged axial dimension. According to another embodiment, these spikes have enlarged diametral dimensions and apex angles. According to still another embodiment, these spikes may have enlarged axial dimensions and enlarged diametral dimensions. According to still another embodiment, these spikes may have enlarged diametral dimensions along only a part of the axial dimension.

According to a feature of the invention, the soles are of constant transverse thicknesses. In other words, the soles are not wedge-shaped or tapered from one side to the other. According to another feature, the enlarged dimension is at least about twice the corresponding dimension of the remainder of the spikes.

According to still another aspect of the invention, there is provided a method of improving the stance of a golfer having a dominant side. This golfer will, in the conventional course of playing golf, wear shoes with spikes depending therefrom as noted above. The method comprises enlarging at least one dimension of selected of the spikes on only that one of the shoes corresponding to the golfer's dominant side to brace said shoe at about 15–25 degrees from the horizontal. As noted above, the method may comprise enlarging the length of the selected spikes whereas it is also possible to enlarge the diameter and apex angle of the selected spikes.

The above and other objects, features and advantages of the invention will be apparent from the detailed description which follows hereinafter.

BRIEF DESCRIPTION OF DRAWING

In the drawing:

FIG. 1 is a front pictorial view of a golf shoe for the right foot of a golfer employing spikes arranged in accordance with one embodiment of the invention;

FIG. 2 is a view corresponding to FIG. 1 but showing the effects of the spikes on the golf shoe upon penetration into the ground;

FIG. 3 is a bottom perspective view of the golf shoe of FIGS. 1 and 2;

FIG. 4 is a view of a spike which can be employed in accordance with another embodiment of the invention; and FIG. 5 is a side view of a spike which can be employed in accordance with yet another embodiment of the invention.

DETAILED DESCRIPTION

According to the invention there is provided footwear for a golfer. The footwear provided in accordance with the invention comprises a pair of shoes conventionally including soles with spikes depending therefrom. The pair of shoes is provided for the left foot and for the right foot of the golfer.

It is well known that golfers will normally have dominant sides unless they are ambidexterous. Golfers with dominant sides are known as left-handed and right-handed golfers respectively. A right-handed golfer stands with his left foot forward or in the direction in which he expects to propel the ball. The right foot is in rearward or trailing direction. A left-handed golfer stands with his right foot forward and with his left foot in trailing direction. Both of these golfers with their respective dominant sides have a back swing during which the golf club is cocked rearwardly during a period in which the golfer tends to sway rearwardly and bring his body out of constant attitude relative to the golf ball which is the object of the swing. The invention provides for preventing this sway and may be used both during play and for instructional purposes such as during practice.

In accordance with the invention, while there is provided a pair of shoes inclusive of spikes, it is only the rearmost shoe corresponding to the dominant side of the golfer which is modified to provide the benefits of the invention. The golf shoe shown in FIGS. 1–3 is a shoe for the right foot of the golfer and is thus intended for a golfer whose dominant side is his right side. The right shoe illustrated at 10 in FIGS. 1–3 is intended to brace the golfer's foot at an angle A bearing somewhere between 15 and 25 degrees to the horizontal as appears in FIG. 2 and preferably an angle in the vicinity of about 20 degrees.

The shoe 10 conventionally has an upper part 12 adapted to surround the foot of the wearer and a sole 14 which is conventionally of constant thickness in transverse cross-section and is not wedge-shaped or tapered as is required by certain previously patented shoes. The embodiment of the invention illustrated in FIGS. 1–3 includes a line of standard or conventional monolithic spikes 16, 18, 20, 22 and 24 which are adjacent the inner periphery or edge of the golf shoe 10 and a line of monolithic spikes 26, 28, 30, 32, 34 and 36 which are adjacent the outer periphery of the golf shoe 10. There is also an additional spike 38 which is at the front of the shoe 10 but which may also be considered as included in the line of spikes adjacent the outer periphery of the shoe.

As appears more particularly in FIG. 1 the shoe 10 includes spikes having a number of dimensions which are significant. One dimension is indicated at B. This dimension is the diametral dimension of the spikes involved. A further dimension is indicated at C. This dimension is the axial length of the spikes involved. Still another dimension appears at D, this dimension being the diametral dimension of a spike at its distal end; i.e., the end of the spike remote from the sole to which the spike is attached in depending relationship.

Appearing in the view of FIG. 1 are spikes 24, 38 and 36. Spikes 36 and 38 correspond in dimension. They are larger than the spike 24 which is representative of the conventional or standard spikes forming a line along the inner periphery or edge of the shoe 10. The spike 24 is, as noted above, of normal conventional or standard length. It is, for example, of a length of about 5/16 of an inch. Contrary thereto, spikes 36 and 38 as well as all of the other spikes extending adjacent the outer periphery of the shoe 10 are of an axial dimension at least twice that of the spike 24. They are, for example, ⅞ of an inch long thereby being as stated above at least about twice the corresponding dimension of the smaller spikes. The distal end diameter D of spikes 36 and 38 and the other corresponding spikes is about 3/16 of an inch. This is significantly greater than that of the spike 24, the end of which is substantially pointed. The spikes are constructed from the same type of steel or other such metal as the other conventional spikes. As is apparent from FIG. 2 the spikes 26–38 prevent the outer periphery from approaching too closely to the ground whereas the smaller spikes 16–24 penetrate readily in the ground thereby giving the shoe an inclined attitude as appears in FIG. 2. As a result, the golfer has his rearward strong side foot braced in tilted position thereby bracing the golfer against sway and imparting to the golfer a feel which will ultimately significantly improve his game.

There are other ways of achieving the benefits of the invention by varying the dimensions of the outward line of spikes on the rearward dominant side shoe. One of these ways involves employing the type of spike illustrated in FIG. 4 wherein appears a spike 50. This spike includes the usual cup-shaped flange 52 and a threaded portion 54. The threaded portion 54 may preferably include a heavier or stronger thread than is conventional in order to add strength to the spike giving the bracing action. This feature may also be employed in the embodiment of FIGS. 1–3.

In FIG. 4 the shape of a conventional spike is indicated at 56 by the use of dotted lines. The solid illustration at 58 indicates that the spike of the presently described embodiment of the invention is of a corresponding axial length but that it has a diametral dimension D1 at, for example, the mid point of the height of the spike which is substantially greater than the corresponding dimension D2 of the standard spike. This provides for an apex angle M which is substantially greater for the spike of the invention than it is for the standard spike. This increased apex angle will resist penetration of the spike into the ground thereby urging the shoe 10 into tilted attitude bracing the rearward foot of the golfer such that sway is avoided and the golfer's swing is significantly improved.

Another embodiment of the invention appears in FIG. 5 in the form of a spike 70. The spike 70 includes a flange 72 and a threaded portion 74 as described above relative to FIG. 4. In this embodiment of the invention, the pointed portion of the spike indicated at 76 may be of conventional dimension or modified. What is significant in FIG. 5 is the truncated conical portion 78 presenting a flat lower surface of annular form such as indicated at 80. This flat face will brace against the turf or grass upon which the golfer is standing, thus, urging the shoe into tilted attitude much as illustrated in FIG. 2 and preventing sway in the manner which has been discussed hereinabove.

In each of the embodiments of the invention noted hereinabove by way of illustration, it is seen that the spikes employed in accordance with the invention have axial and diametral dimensions at least one of which is enlarged so as to exceed substantially the corresponding dimension of the other of the spikes employed on the same shoe and employed in entirety on the other or foremost shoe. The enlarged dimension is in most cases at least about twice the corresponding dimension of the smaller spikes.

By implication, it now follows that the invention provides a method of improving the stance of a golfer having a dominant side. The golfer wears shoes with spikes depending therefrom and the method comprises enlarging at least one dimension of selected of the spikes on only one of the shoes corresponding to the dominant side of the golfer to brace said one shoe at about 15–25 degrees from the horizontal. The dimensions as noted hereinabove which may be enlarged include the length, diameter and apex angle of the selected spikes.

There will now be obvious to those skilled in the art many modifications and variations of the structures and methods set forth hereinabove. These modifications and variations will not depart from the scope of the invention if defined by the following claims.

What is claimed is:

1. Footwear for a golfer comprising a pair of shoes for the left and right feet of the golfer, each of said shoes including a sole and monolithic spikes depending from said sole, said sole having inner and outer peripheries adjacent which said spikes are located, said spikes having diametral and axial dimensions, all of the spikes on one of said shoes and the spikes adjacent the inner periphery of the other of said shoes having substantially the same diametral and axial dimensions, at least some of the spikes adjacent the outer periphery of said other shoe having at least one of said dimensions enlarged so as to exceed substantially the corresponding dimension of the spikes on said one shoe and on the inner periphery of said other shoe.

2. Footwear for a golfer as claimed in claim 1 wherein the spikes adjacent the outer periphery of said other shoe have an enlarged axial dimension.

3. Footwear for a golfer as claimed in claim 1 wherein the spikes adjacent the outer periphery of said other shoe have an enlarged diametral dimension and apex angle.

4. Footwear for a golfer as claimed in claim 1 wherein the spikes adjacent the outer periphery of said other shoe have an enlarged axial dimension and an enlarged diametral dimension.

5. Footwear for a golfer as claimed in claim 1 wherein the spikes adjacent the outer periphery of said other shoe have an enlarged diametral dimension along only a part of said axial dimension.

6. Footwear for a golfer as claimed in claim 1 wherein the soles are of equal constant transverse thicknesses.

7. Footwear for a golfer as claimed in claim 1 wherein the enlarged dimension is at least about twice the corresponding dimension on the remainder of the spikes.

8. A method of improving the stance of a golfer having a dominant side, said golfer wearing shoes with spikes depending therefrom, said method comprising enlarging at least one dimension of selected of the spikes, while maintaining the monolithic character thereof, on only the one of said shoes corresponding to said dominant side to brace said one shoe at about 15–25 degrees from the horizontal.

9. A method as claimed in claim 8 comprising enlarging the length of said selected spikes.

10. A method as claimed in claim 8 comprising enlarging the diameter and apex angle of said selected spikes.

11. A method as claimed in claim 8 wherein said one shoe has inner and outer peripheries adjacent which the spikes are located, said selected spikes being adjacent said outer periphery of the shoe on the dominant side.

* * * * *